United States Patent [19]

Pepin

[11] Patent Number: 4,512,130

[45] Date of Patent: Apr. 23, 1985

[54] INSULATION SUPPORT

[76] Inventor: Jean P. Pepin, Civic Center Dr., Augusta, Me. 04330

[21] Appl. No.: 360,220

[22] Filed: Mar. 22, 1982

[51] Int. Cl.[3] ..... F04B 1/74

[52] U.S. Cl. ..... 52/404; 52/DIG. 6; 52/484; 411/466

[58] Field of Search ..... 52/DIG. 6, 404, 486, 52/484, 506, 412, 410, 735; 411/461, 466–467, 468, 470

[56] References Cited

U.S. PATENT DOCUMENTS

| | | | |
|---|---|---|---|
| 705,626 | 7/1902 | Vogel | 52/DIG. 6 |
| 800,655 | 10/1905 | Kitsee | 52/DIG. 6 |
| 1,520,026 | 12/1924 | Hugh | 52/DIG. 6 |
| 1,712,493 | 5/1929 | Elmendorf | 52/DIG. 6 |
| 1,782,695 | 11/1930 | Prez | 411/466 |
| 1,915,611 | 6/1933 | Miller | 52/DIG. 6 |
| 1,995,173 | 3/1935 | Ehle | 52/DIG. 6 |
| 2,284,301 | 5/1942 | Rieser | 52/DIG. 6 |
| 2,580,231 | 12/1951 | Lamm | 52/DIG. 6 |
| 3,011,226 | 12/1961 | Menge | 411/466 |
| 3,016,586 | 1/1962 | Atkins | 52/DIG. 6 |
| 4,023,323 | 5/1977 | Fortin | 52/712 |
| 4,069,636 | 1/1978 | Kessler | 52/712 |
| 4,235,148 | 11/1980 | Menge | 52/DIG. 6 |
| 4,292,777 | 10/1981 | Story | 52/407 |
| 4,389,190 | 6/1983 | Sevink | 52/486 |

FOREIGN PATENT DOCUMENTS

| | | | |
|---|---|---|---|
| 2730525 | 1/1979 | Fed. Rep. of Germany | 52/512 |
| 167276 | 8/1921 | United Kingdom | 52/410 |

*Primary Examiner*—John E. Murtagh
*Assistant Examiner*—Kathryn L. Ford

[57] ABSTRACT

A support member for batt or sheet insulation in which straps are placed at intervals in the void to be insulated. Prongs extend from the straps at substantially right angles. The prongs are pushed into the insulation to hold the insulation in the void.

5 Claims, 2 Drawing Figures

INSULATION SUPPORT

BACKGROUND

1. The Field of the Invention

My invention relates to the field of insulation supports. In particular, my invention is in the field of batt or sheet insulation supports for building walls, ceilings and roofs. The principle of the invention is to put straps in the voids which are to be insulated. When the straps are in place, prongs which are produced by partial cutouts in the straps are bent substantially at right angles away from the strap. The prongs then impale the insulation and hold it in the void to prevent sagging or settling of the insulation and consequent increase in heat transfer.

2. The Prior Art

One method of holding insulation batts in place has been to provide the insulation batt with paper flanges which can be tacked or stapled to the wooden studs of the building wall or the wooden beams of a ceiling, roof or floor. This practice works out well in residential construction but cannot be used in the insulation of commercial buildings where metal wall studs and metal horizontal roof or floor purlins are used.

Another approach when insulating masonry walls has been to attach nails to the masonary walls by means of an adhesive applied to the nail head. The disadvantage here is getting the nail head to stick to the masonry that may be old and dusty brickwork. A third approach has been to insert bars or wires in the voids to be insulated. This system has the disadvantages of high cost and high labor content.

Yet another approach, shown in the U.S. Pat. No. 3,231,944 to Bennett involves stiffeners built into the insulation batts with prongs on the end of the stiffeners to engage the wooden studs that define the insulation void. The disadvantage of this system includes the fact that the void must be exactly the distance apart required by the batt; this ideal is seldom obtained in building construction. This system is intended for the use of wooden studs and it requires that the insulation batt be distorted by the stiffeners to hold the insulation batt in the void.

SUMMARY OF THE INVENTION

My invention is a solution to the problem of how to keep batt or sheet insulation in building voids regardless of the material used to form the voids. Straps are placed in the void to be insulated. At intervals along tbe straps rigid prongs are extended at right angles to the strap. The insulation batt or sheet is then impaled on the prongs. This prevents the insulation batt or sheet from moving under the effects of gravity and vibration when it is out of sight behind a finished wall, ceiling, roof or floor. Thus, the full insulating value of the sheet or batt is retained for the life of the building without the loss of insulating valve caused by the insulation settling due to its own weight.

DESCRIPTION OF PREFERRED EMBODIMENT

Figure 1:
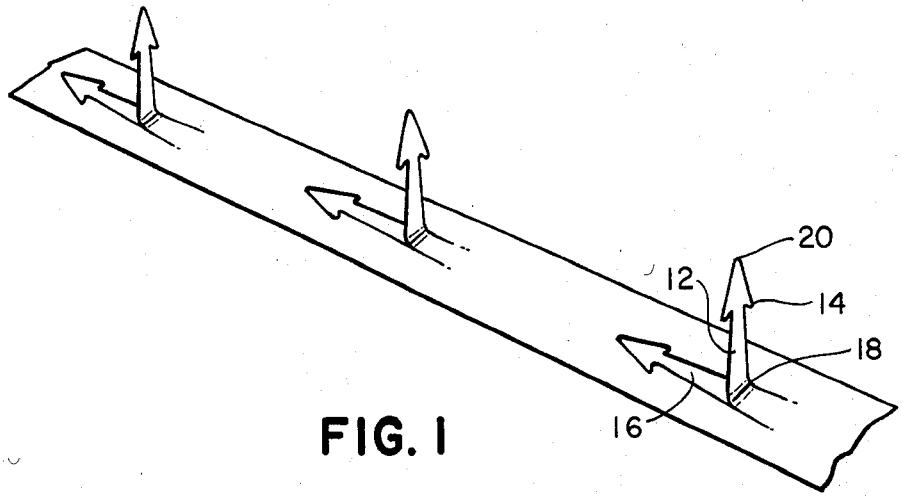
FIG. 1 is a perspective view of the invention.

As shown in the drawings, where like numerals refer to like parts throughout, a strap 10 is cut from a suitable material such as galvanized sheet steel. Prongs such as prong 12 are produced at intervals along the strap 10 by bending partial cutouts in the strap itself. The prongs such as prong 12 are substantially at right angles to the plane of the strap member 10. The prongs may be pointed at the end of the prong remote from the strap member 10 such as a point 20 on the prong 12. The point 20 aids in inserting a batt of insulation over the prong. Barbs such as barb 14 on prong 12 may be used to prevent the insulation batt from slipping off the prongs particularly if the insulation is being applied to a horizontal surface such as a floor or ceiling.

Figure 2:
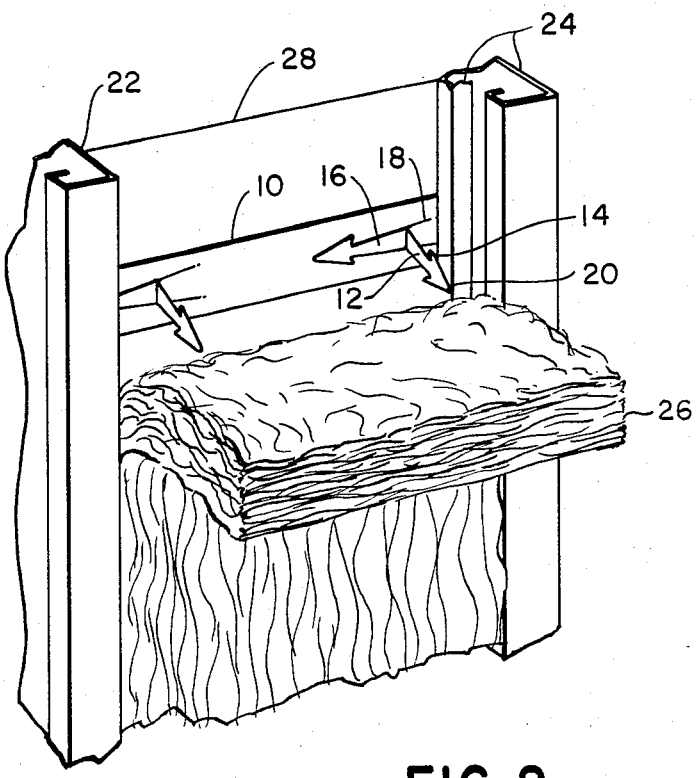
FIG. 2 is a partial elevation of the invention used to support batt insulation in a wall.

Referring to FIG. 2, it may be seen how the invention is applied to a building wall where the wall voids are formed by vertical metal studs such as studs 22 and 24. The straps 10 are installed horizontally between the studs 22 and 24 with the prongs such as prong 12 pointed away from a wall covering 28. It is thus seen as shown in the figures that the strap forms a flat bearing surface for bearing against and fastening to a structure surface. The prongs or insulation support members, on the other hand, are folded outwardly at an angle generally normal to the bearing surface. Insulation, in this case a batt of glass fibers 26, is pushed into the void formed by the vertical metal studs 22 and 24. The prongs such as prong 12 penetrate the glass fiber batt 26 and hold it from settling and keep it permanently in place to prevent the consequent loss of insulation and increased heat loss.

OPERATION

In operation, the strap members such as the strap member 10 are fastened either to the surface 28 or to the metal studs 22 and 24 of FIG. 2. The strap member 10 may be nailed to the wall surface 28 or it may be attached to the metal studs using the appropriate fasteners such as self tapping screws. If the strap members are attached to the studs, they add a measure of stiffness to the finished wall as well as holding up the insulation batts 26. If the wall covering 28 is masonry, the strap members may be attached to it by the use of masonry nails or other fasteners adapted to masonry.

Although the strap member 10 is shown running at right angles to the studs 22 and 24 in FIG. 2, it should be understood that the straps may be also fastened parallel to the stuuds or at some angle. The length of the prong 12 should be chosen to match the thickness of insulation batt 26. I have found that prong lengths of 3 inches are suitable for most commercially available fiber insulation batts. I have found that the best spacing for the insulation holding strap 10 is 6 inches down from the top of the batt for wall insulation. I then put a strap every four feet in the wall void. The spacing can be varied to the weight of any insulation. If the insulation is installed in less than full length sheets, I install an insulation holding strap at each insulation joint. I find that barbs such as barb 14 on prong 12 to be very efficient for holding the insulation batt in the void when the batt is being installed horizontally in ceiling, floor or roof applications.

Although the invention is illustrated with thermal insulation, it will be understood that it is also useful for sound insulation such as acoustic insulation used in auditoriums. I have found it convenient and economical to manufacture the prongs by making a partial outout in the strap 10 leaving an uncut web or piece of metal 18 at the right side of each prong as illustrated in FIG. 1 at prong 12. The insulation straps or supports are shipped and installed in the flat configuration with the prongs partially cutout. Once the straps 10 are installed, the workman can grasp the prong 12 near its point 20 and thus bend the metal web 18 until the prong 12 is at right angles to the strap 10. This leaves a cutout 16 in the strap 10. I have found spacing of the prongs along the strap 10 should be such as that there are at least two prongs in each void to be insulated. The insulation holder of the present invention is simple to manufacture and use and enables the builder to cover over insulated building voids with the knowledge that over a period of time the insulation will not settle unseen in the building void.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents may be resorted to falling within the scope of the invention as claimed.

I claim:

1. An improved building insulation system comprising fiber insulation (26) and improved apparatus for supporting and retaining said fiber insulation (26) on a wall, ceiling, partition or other structure surface (28) of a building wherein the improved apparatus comprises:

elongate strap means (10) constructed and arranged with a flat bearing face portion for bearing and fastening against a structure surface of a building;

a plurality of elongate insulation support members (12) formed in the strap means (10) each insulation support member (12) having a free end (20) and a stem end (18) merging with the strap means (10) and being formed with sufficient length from the stem end to the free end to match the thickness of the fiber insulation (26) to be supported and retained, each said insulation support member (12) constructed and arranged to be manually foldable at the stem end by installation workers to extend at an angle from the strap means (10) for supporting and retaining insulation, each said elongate support member being formed with a declining taper at the free end (20) for impaling and supporting fiber insulation (26) on the support member (12), said elongate support member (12) also being formed with at least one barb (14) at the free end (20) for retaining fiber insulation impaled thereon;

said elongate strap means (10) being formed with the plurality of elongate insulation support members (12) cut in the elongate strap means (10) along cutouts (16) in a row with the elongate axes of the insulation support members (12) and cutouts (16) parallel with the elongate axis of the strap means (10);

said elongate insulation support members (12) being initially formed generally in the same plane with the strap means (10) for installation of the strap means (10) on a structure surface (28) with the elongate insulation support members (12) lying in substantially the plane of the strap means (10) whereby installation workers may subsequently fold the elongate insulation support members at an angle projecting from the strap means (10) for support of insulation (26) upon installation of the insulation.

2. The improved apparatus of claim 1 wherein the insulation support members (12) are in the configuration of elongate arrows having a tapering free end with two barbs.

3. The improved apparatus of claim 1 wherein the structure surface (28) comprises studs and the elongate strap means (10) are secured to said studs.

4. An improved insulation system comprising fiber insulation (26) and improved apparatus for supporting and retaining said fiber insulation (26) on a wall, ceiling, partition or other structure surface (28) of a building wherein the improved apparatus comprises:

a plurality of elongate strips (10) constructed and arranged with a flat bearing face portion for bearing and fastening against a structure surface (28) of a building, said plurality of elongate strips arranged in substantially parallel spaced-apart configuration on a structure surface;

a plurality of elongate insulation support members (12) formed in a row along each said elongate strip, each insulation support member (12) having a free end (20) and a stem end (18) merging with the elongate strip (10) and being formed with sufficient length from the stem end to the free end to match substantially the thickness of the fiber insulation (26) to be supported and retained, each said insulation support member (12) constructed and arranged to be manually foldable at the stem end by installation workers to extend at an angle from the elongate strip (10) for supporting insulation, said elongate support member being formed with a declining taper at the free end (20) for impaling and supporting insulation (26) on the insulation support member (12), said elongate insulation support member (12) also being formed with a pair of barbs (14) providing an arrowhead configuration at the tip of the free end (20) for retaining insulation impaled on the elongate insulation support member;

each elongate strip (10) being formed with the plurality of elongate insulation support members (12) cut in the elongate strip (10) along cutouts (16) with the elongate axes of the insulation support members (12) and cutouts (16) parallel with the elongate direction of the strip (10);

said elongate insulation support members (12) being initially formed generally in the same plane with the elongate strips (10) for installation of the elongate strips (10) on a structure surface (28) of a building with the elongate insulation support members (12) lying in substantially the plane of the elongate strips (10) whereby installation workers may subsequently fold the elongate insulation support members (12) at an angle projecting from the elongate strips (10) after the elongate strips (10) are fastened to a structure surface (28) for support of the insulation (26) thereby leaving said cutouts (16) in the elongate strips (10) upon installation of the insulation.

5. The improved apparatus of claim 4 wherein the stem end of each said elongate insulation support member (12) comprises an uncut web or piece of metal (18) to facilitate bending of the elongate insulation support member (12) from the stem end at said uncut web or piece of metal.

* * * * *